US006921353B2

(12) United States Patent
Chuang

(10) Patent No.: US 6,921,353 B2
(45) Date of Patent: Jul. 26, 2005

(54) STEPPING EXERCISER HAVING ROTATABLE FOOT PEDALS

(76) Inventor: Jin Chen Chuang, P.O. Box 63-99, Taichung (TW), 406

( * ) Notice: Subject to any disclaimer, the term of this patent is extended or adjusted under 35 U.S.C. 154(b) by 188 days.

(21) Appl. No.: 10/347,919

(22) Filed: Jan. 17, 2003

(65) Prior Publication Data

US 2004/0142795 A1 Jul. 22, 2004

(51) Int. Cl.[7] ..... A63B 22/04
(52) U.S. Cl. ..... 482/52; 482/51; 482/146
(58) Field of Search ..... 482/51, 52, 53, 482/79, 80, 148, 70, 146, 147

(56) References Cited

U.S. PATENT DOCUMENTS

| | | | | |
|---|---|---|---|---|
| 3,612,519 | A | 10/1971 | Larson | 482/147 |
| 5,183,448 | A | 2/1993 | Wang | 482/52 |
| 5,298,002 | A | 3/1994 | Lin | 482/53 |
| 5,632,711 | A | 5/1997 | Hwang | 482/147 |
| 5,807,210 | A | 9/1998 | Devlin | 482/52 |
| 6,595,899 | B2 | 7/2003 | Liang | 482/53 |

*Primary Examiner*—Stephen R. Crow
(74) *Attorney, Agent, or Firm*—Charles E. Baxley

(57) ABSTRACT

A stepping exerciser includes a base having a frame, a lever having a middle portion pivotally secured to the frame and having two ends, and two foot pedals rotatably attached to the ends of the lever to rotatably support users. The stepping exerciser includes a simplified and compact structure that is excellent for storing and transportation purposes, and includes rotatable foot pedals for comfortably supporting users.

1 Claim, 2 Drawing Sheets

STEPPING EXERCISER HAVING ROTATABLE FOOT PEDALS

BACKGROUND OF THE INVENTION

1. Field of the Invention

The present invention relates to a stepping exerciser, and more particularly to a stepping exerciser having rotatable foot pedals.

2. Description of the Prior Art

Typical stepping exercisers have been developed and widely used today. U.S. Pat. No. 5,183,448 to Wang discloses one of the typical stepping exercisers and comprises a pair of foot pedals pivotally secured to a base with a pair of arms or levers or the like, such that the typical stepping exercisers comprise a large number of parts or elements, and comprise a huge volume that is adverse for storing and transportation purposes. In addition, a large space will be occupied or used in house buildings.

The present invention has arisen to mitigate and/or obviate the afore-described disadvantages of the conventional stepping exercisers.

SUMMARY OF THE INVENTION

The primary objective of the present invention is to provide a stepping exerciser including a simplified and compact configuration that is excellent for storing and transportation purposes.

The other objective of the present invention is to provide a stepping exerciser including rotatable foot pedals for comfortably supporting users.

In accordance with one aspect of the invention, there is provided a stepping exerciser comprising a base including a frame provided thereon, a lever including a middle portion pivotally secured to the frame with a pivot shaft, and two ends movable up and down relative to the base when the lever is rotated relative to the base and the frame about the pivot shaft, and two foot pedals rotatably attached to the ends of the lever to rotatably support users. The stepping exerciser includes a simplified and compact configuration that is excellent for storing and transportation purposes, and includes rotatable foot pedals for comfortably supporting users.

Two blocks may further be provided and pivotally attached to the ends of the lever, the foot pedals are rotatably supported on the blocks respectively.

The blocks each includes an orifice formed therein, the foot pedals each includes an axle rotatably engaged into the orifice of the block respectively.

A beam may further be provided and includes a middle portion pivotally secured to the frame with a pivot shaft, and two ends pivotally secured to the blocks with pivot pins respectively.

A resistive force applying device may further be provided to apply a resistive force against the foot pedals. For example, the resistive device may couple the base to the foot pedals, or to the blocks, or to the levers, to apply the resistive force against the foot pedals.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 2:
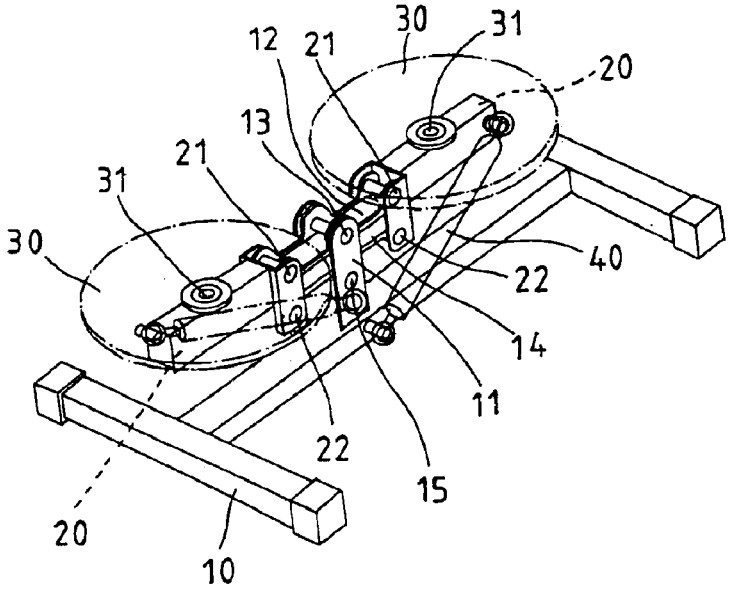
FIG. 2 is a perspective view of the stepping exerciser.
Figure 1:
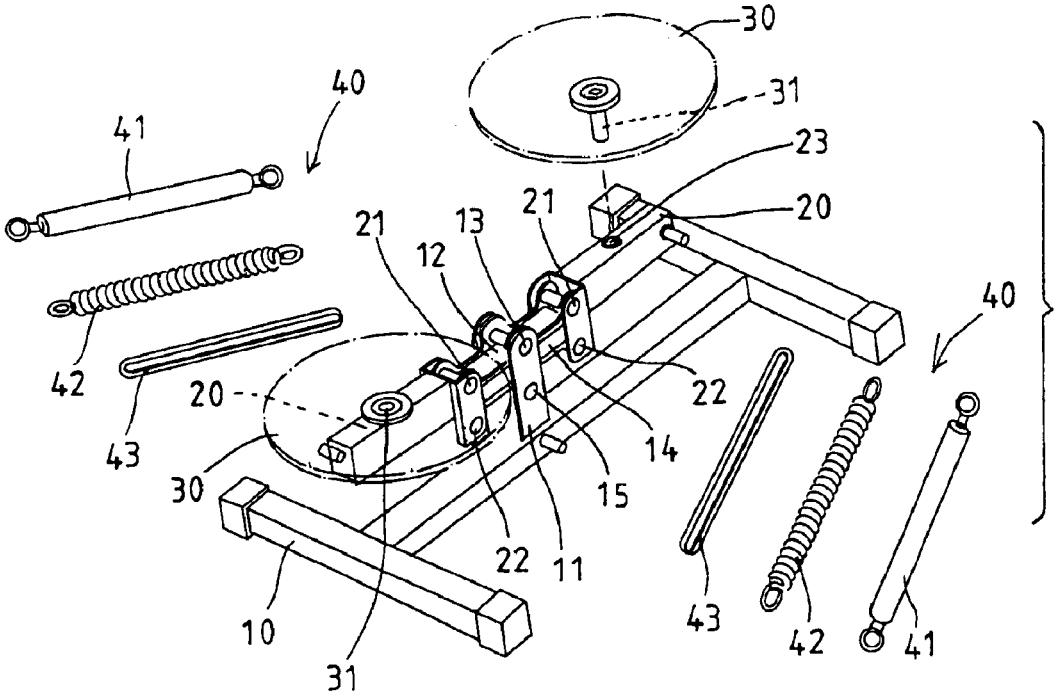
FIG. 1 is a partial exploded view of a stepping exerciser in accordance with the present invention.
Figure 3:
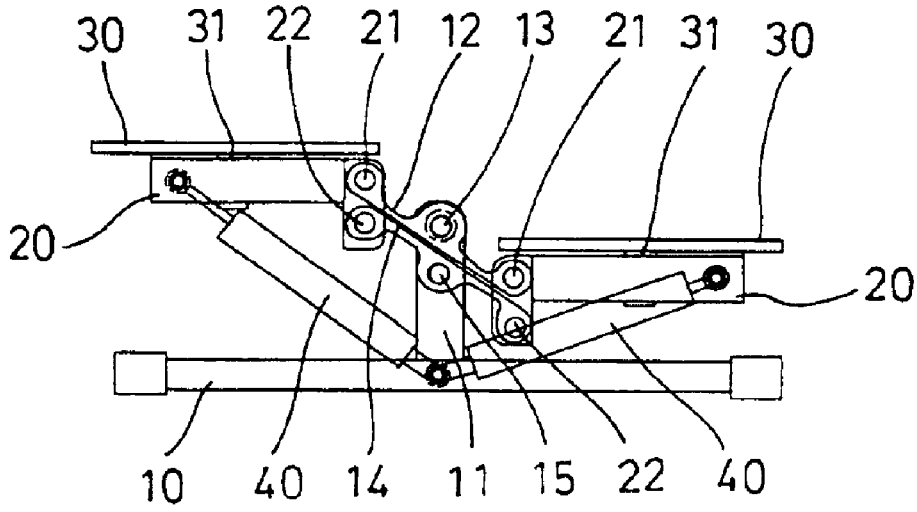
FIG. 3 is a plan schematic view of the stepping exerciser.

Referring to the drawings, and initially to FIGS. 1–3, a stepping exerciser in accordance with the present invention comprises a base 10 for being supported on ground or any suitable supporting surfaces. The base 10 includes a stay or a support or a frame 11 disposed thereon, or extended upwardly therefrom.

A lever 12 includes a middle portion pivotally or rotatably secured to the frame 11 with a pivot shaft 13, for allowing the lever 12 to be rotated relative to the base 10 or the frame 11 about the pivot shaft 13. A beam 14 also includes a middle portion pivotally or rotatably secured to the frame 11 with a pivot shaft 15, for allowing the beam 14 to be rotated relative to the base 10 or the frame 11 about the pivot shaft 15.

Figure 4:
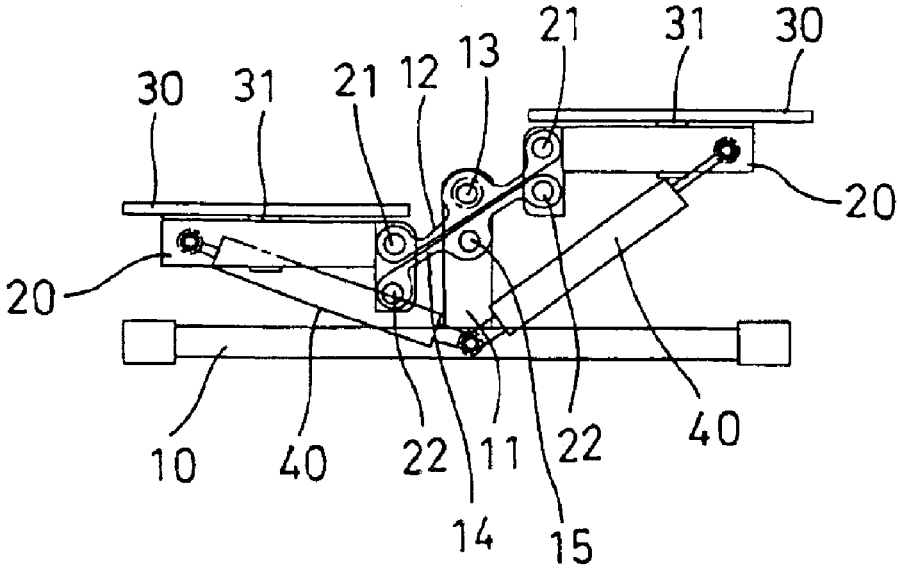
FIG. 4 is a plan schematic view similar to FIG. 3, illustrating the operation of the stepping exerciser.

A pair of blocks 20 secured to the ends of the lever 12 and the beam 14 with pivot pins 21, 22. The lever 12 and the beam 14 are parallel to each other, such that the lever 12 and the beam 14 and/or the pivot pins 21, 22 form a parallelogrammic structure whenever the blocks 20 move up and down relative to the base 10. In addition, the blocks 20 may be maintained in a horizontal position whenever the blocks 20 move up and down relative to the base 10 (FIGS. 3, 4).

The blocks 20 each includes an orifice 23 formed therein (FIG. 1). Two foot pedals 30 each includes an axle 31 extended downwardly therefrom and rotatably engaged into the orifice 23 of the respective block 20, for allowing the foot pedals 30 to be rotatably secured to the blocks 20 with the axles 31 respectively, and to rotatably support users thereon.

One or more resistive means or devices 40 may optionally or selectively provided and attached to or coupled between the base 10 and the blocks 20 and/or the lever 12 and/or the beam 14, to provide a resistive force against the up and down movement of the blocks 20 and/or the foot pedals 30.

For example, the resistive devices 40 may be the hydraulic or pneumatic cylinders 41, or springs 42, or resilient belts 43, that may be provided to couple the base 10 to either the blocks 20 or the lever 12 or the beam 14, and thus to optionally or selectively provide a resistive force against the stepping movement or the up and down movement of the blocks 20 and/or the foot pedals 30.

It is to be noted that the blocks 20 and/or the foot pedals 30 are directly and rotatably supported or attached to the ends of the lever 12 and/or the beam 14, such that the stepping exerciser may include a compact configuration that is excellent for both storing and transportation purposes. In addition, the foot pedals 30 may rotatably support the feet of the users on the blocks 20, for preventing the users from being twisted while conducting stepping exercises.

Accordingly, the stepping exerciser in accordance with the present invention includes a simplified and compact configuration that is excellent for storing and transportation purposes, and includes rotatable foot pedals for comfortably supporting users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A stepping exerciser comprising:

a base including a frame provided thereon, a linear lever including a middle portion pivotally secured to said frame with a pivot shaft, and two ends movable up and down relative to said base when said lever is rotated relative to said base and said frame about said pivot shaft, two blocks pivotally attached to said ends of said lever, said blocks each including an orifice formed therein, two foot pedals rotatably attached to said ends of said lever to rotatably support users, said foot pedals each including an axle rotatably engaged into said orifice of said block respectively, to rotatably support said foot pedals on said blocks respectively, a linear beam including a middle portion pivotally secured to said frame with a pivot shaft, and including two ends pivotally secured to said blocks with pivot pins respectively, said lever and said beam having a colinear arrangement, resistive force applying means for applying a resistive force against said foot pedals, said resistive force applying means including a resistive device coupled between said base and said blocks, to apply the resistive force against said foot pedals.

* * * * *